US008382494B2

(12) United States Patent
Weigel

(10) Patent No.: US 8,382,494 B2
(45) Date of Patent: Feb. 26, 2013

(54) GROUNDING CONTACT FOR AN AXLE HAVING A SLIDING CONTACT ELEMENT AND A SENSOR

(75) Inventor: Wilfried Weigel, Dautphetal (DE)

(73) Assignee: Schunl Bahn-und Industrietechnik GmbH, Wettenberg (DE)

( * ) Notice: Subject to any disclaimer, the term of this patent is extended or adjusted under 35 U.S.C. 154(b) by 0 days.

(21) Appl. No.: 13/212,446

(22) Filed: Aug. 18, 2011

(65) Prior Publication Data

US 2012/0052701 A1 Mar. 1, 2012

(30) Foreign Application Priority Data

Aug. 26, 2010 (DE) ..... 10 2010 039 847

(51) Int. Cl.
*H01R 13/648* (2006.01)

(52) U.S. Cl. ..... 439/108

(58) Field of Classification Search ..... 439/92, 439/101, 103, 104, 108, 26
See application file for complete search history.

(56) References Cited

U.S. PATENT DOCUMENTS

| | | | | |
|---|---|---|---|---|
| 5,622,437 | A * | 4/1997 | Alff | 384/448 |
| 6,179,471 | B1 * | 1/2001 | Moretti et al. | 384/448 |
| 6,522,127 | B1 * | 2/2003 | De Fleury et al. | 324/207.16 |
| 6,675,640 | B2 * | 1/2004 | Ehrlich et al. | 73/115.08 |
| 7,698,962 | B2 * | 4/2010 | LeFebvre et al. | 73/862.621 |
| 2003/0176087 | A1 * | 9/2003 | Erez et al. | 439/108 |
| 2006/0128185 | A1 * | 6/2006 | Nakazawa et al. | 439/92 |
| 2010/0041257 | A1 * | 2/2010 | Beck et al. | 439/108 |
| 2011/0130016 | A1 * | 6/2011 | Lacey et al. | 439/108 |

FOREIGN PATENT DOCUMENTS

| | | | |
|---|---|---|---|
| DE | 19654339 | A1 | 6/1998 |
| DE | 29907598 | U1 | 8/1999 |
| DE | 19920384 | C1 | 8/2000 |
| DE | 10012739 | A1 | 9/2001 |
| DE | 69809214 | T2 | 8/2003 |
| EP | 0911241 | A1 | 4/1999 |
| EP | 0959362 | A1 | 11/1999 |
| EP | 1136340 | A2 | 9/2001 |

OTHER PUBLICATIONS

European Patent Office Search Report, Application No. 11173185.7, Jan. 6, 2012.
Abstract of correspondent EP 0976638 for Foreign Patent No. DE 69809214.

* cited by examiner

*Primary Examiner* — Chandrika Prasad
(74) *Attorney, Agent, or Firm* — Quarles & Brady LLP

(57) ABSTRACT

A grounding contact (10) for an axle, particularly an axle of a rail vehicle or the like, includes a housing unit (12), a contact device (16) and a sensor device (24). The housing unit consists of a housing structure (13) and a housing cover (14), wherein the contact device consists of a sliding contact element (17) that may be attached to an axle and of a contact element (18), wherein an electrical sliding contact can be created between the sliding contact device and the contact element, wherein the sensor device consists of a signal output device and at least one sensor for acquiring operating parameters of the axle. The sensor device is arranged inside the housing unit and the signal output device is able to output at least two signals having differing structures.

12 Claims, 2 Drawing Sheets

GROUNDING CONTACT FOR AN AXLE HAVING A SLIDING CONTACT ELEMENT AND A SENSOR

CROSS-REFERENCE TO RELATED APPLICATION

This application claims the priority benefit of German Patent Application No. 10 2010 039 847.0 filed on Aug. 26, 2010, the contents of which are hereby incorporated by reference as if fully set forth herein in their entirety.

STATEMENT CONCERNING FEDERALLY SPONSORED RESEARCH OR DEVELOPMENT

Not applicable.

FIELD OF THE INVENTION

The invention relates to a grounding contact for an axle, particularly an axle of a rail vehicle or the like, having a housing unit, a contact device and a sensor device, wherein the housing unit consists of a housing structure and a housing cover, wherein the contact device consists of a sliding contact element that may be attached to an axle and of a contact element, wherein an electrical sliding contact may be created between the sliding contact device and the contact element, and wherein the sensor device consists of a signal output device and at least one sensor for acquiring operating parameters of the axle.

BACKGROUND OF THE INVENTION

The use of grounding contacts on axles of rail vehicles, particularly electrically driven rail vehicles, is standard. They are used for transmitting electrical currents to a rail via an axle of a wheelset. Known grounding contacts are commonly disposed on an axle on one axial side thereof, and are connected non-rotatably to an axle bracket of the rail vehicle but rotatably relative to the axial side. The grounding contact includes a housing with a housing lid or housing cover constructed in the manner of a flange and disposed on the axial side, wherein graphite contact elements are contacted with the axle and corresponding collector rings or discs inside the housing for transmitting a current.

It is further known to attach a sensor device or a flange-like sensor housing to the housing cover. The housing cover then has an opening through which for example a rotary encoder of the sensor device is able to acquire signals generated by the rotation of an axle. These signals are forwarded via a cable to a vehicle controller that generates operating parameters therefrom, such an axle rotating speed, pulses for a motor controller or brake system, and so forth. This means that the sensor only transmits one signal or channel to the vehicle controller, and the controller processes the signal further for controlling purposes.

Manufacturers of rail vehicles use different signal structures for their various vehicle controllers, in terms of amplitude, frequency, pulse etc. Additionally, each rail network system also requires signals to be adapted to the respective rail network system to enable interaction with a rail vehicle. For example, in order to ensure that a rail vehicle is operable on the rail network systems of two different countries, it must be equipped with sensor devices that are capable of providing the necessary signals. This means that a first grounding contact must be equipped with a sensor or signal output device for a first rail network system, and a second grounding contact must be equipped with a sensor or signal output device for a second rail network system. Accordingly, if the rail vehicle is to be used on a different system it must undergo extensive conversion work, including the replacement or addition of sensor devices. In addition, the necessary sensor devices also differ from one rail vehicle manufacturer to another. A grounding contact manufacturer must therefore provide a large number of sensor devices for a single grounding contact. As a result, both the manufacture of grounding contacts and the process of using rail vehicles in different systems are associated with high costs.

SUMMARY OF THE INVENTION

The task underlying the object of the present invention is therefore to suggest a grounding contact for an axle that simplifies both the process of using a rail vehicle in a different system and the manufacture of the grounding contact.

In one embodiment, this task is solved with a grounding contact having a housing unit, a contact device, and a sensor device. The inventive grounding contact for an axle, particularly an axle of a rail vehicle or the like, includes the housing unit, the contact device and the sensor device, wherein the housing unit consists of a housing structure and a housing cover, wherein the contact device consists of a sliding contact element that may be attached to an axle and of a contact element, wherein an electrical sliding contact may be created between the sliding contact device and the contact element, wherein the sensor device consists of a signal output device and at least one sensor for acquiring operating parameters of the axle. The sensor device is arranged inside the housing unit and the signal output device is able to output at least two signals having differing structures.

Accordingly, there is no longer a need to adapt an additional housing, including a sensor device that is only able to output one signal, to existing housings, as is known from the prior art. Instead, the invention provides for the arrangement of a sensor device inside the grounding contact housing unit, which sensor device enables output of at least two structurally different signals. The advantage of this arrangement is that it is no longer necessary to convert grounding contacts and/or replace sensor devices in order to use a rail vehicle in a different system if the two signals have been adapted to the respective rail network systems. Accordingly, it is also no longer necessary to use two grounding contacts equipped with sensor devices, instead only one grounding contact that delivers the desired signals is required. Moreover, the different signals may take into account the differing vehicle controllers produced by rail vehicle manufacturers. This means that a single grounding contact is suitable for use in two different rail vehicles, so that the manufacture of the grounding contact generally made simpler, since it is no longer necessary to produce two different sensor devices.

In addition, it is advantageous if the signal output device is able to process signal information from the sensor further before it outputs the signal. This means that the sensor device does more than just forward signals originating from sensors to a vehicle controller, the respective signals may also be processed further or modified in the signal output device such that information contained in the signals has already been adapted to the requirements of the vehicle controller and/or a rail network system. Accordingly, the modification of sensor signals takes place in the grounding contact, not in the vehicle controller.

The housing unit may also consist solely of the housing structure and the housing cover. This means that the housing unit may be constructed in two parts, thereby reducing manufacturing costs for the grounding contact. In contrast, the grounding contacts known from the related art use additional housings of various designs as well as a housing cover for a sensor device.

In one embodiment of the grounding contact, the sensor may be a rotary encoder. A rotary encoder enables signals to be obtained for example that are able to deliver an acceleration, a rotating speed, or also pulses for a motor, door or brake controller.

In a further embodiment, the sensor may be a temperature sensor that generates a temperature signal concerning the grounding contact or the axle.

The grounding contact may also be used easily to measure a current flow if the sensor is an ammeter. In this case, it is generally possible to equip the grounding contact with a plurality of sensors that are able to determine the measurement variables described by way of example above.

For example, the signal output device may output at least six signals, each of which has a different structure. In this way, it is possible to respond to a wide range of vehicle controllers and/or rail network systems and/or to acquire a large number of different signals with just a single grounding contact.

The construction and manufacture of a grounding contact may be simplified further if the sensor device is integrated in the housing cover. Thus, if it should become necessary to replace the sensor device or if several different sensor devices are used, it is only necessary to replace the housing cover without having to replace the entire grounding contact.

To this extent, it is also advantageous if the housing cover is constructed as a single part. It is then no longer necessary to use housing covers consisting of multiple parts such as are known from the prior art. This also makes it possible to provide an improved seal for the grounding contact while reducing manufacturing costs.

In order to simplify the integration of sensors in the housing unit, the grounding contact may comprise an axle extension element, via which a sensor may be connected to an axle. The axle extension element enables the sensor, for example a rotary encoder, to be coupled directly to an axle. The rotary encoder may then be placed in any position on the axle extension element inside the housing unit.

In this context, it is advantageous if the axle extension element protrudes into the housing cover. This enables a sensor to be positioned inside the housing cover particularly easily.

The axle extension element may be supported in the housing cover for example in such manner that the axle extension element is able to run particularly smoothly, thus enabling the sensor to record particularly accurate measured values.

BRIEF DESCRIPTION OF THE DRAWINGS

In the following, the invention will be explained in greater detail with reference to the accompanying drawings.

In the drawings.

DETAILED DESCRIPTION OF THE EXAMPLE EMBODIMENTS

Figure 1:
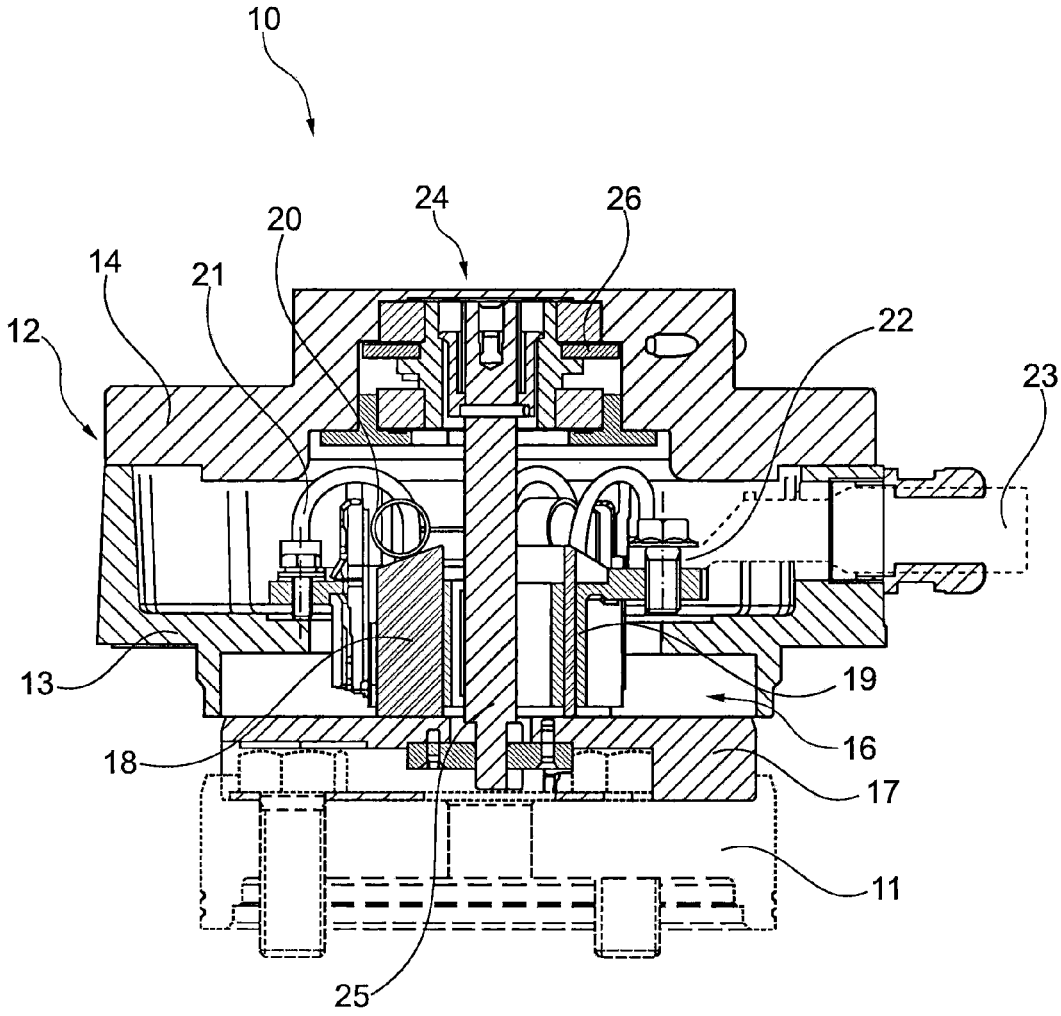
FIG. 1 is a lengthwise view of a cross section through a grounding contact.
Figure 2:
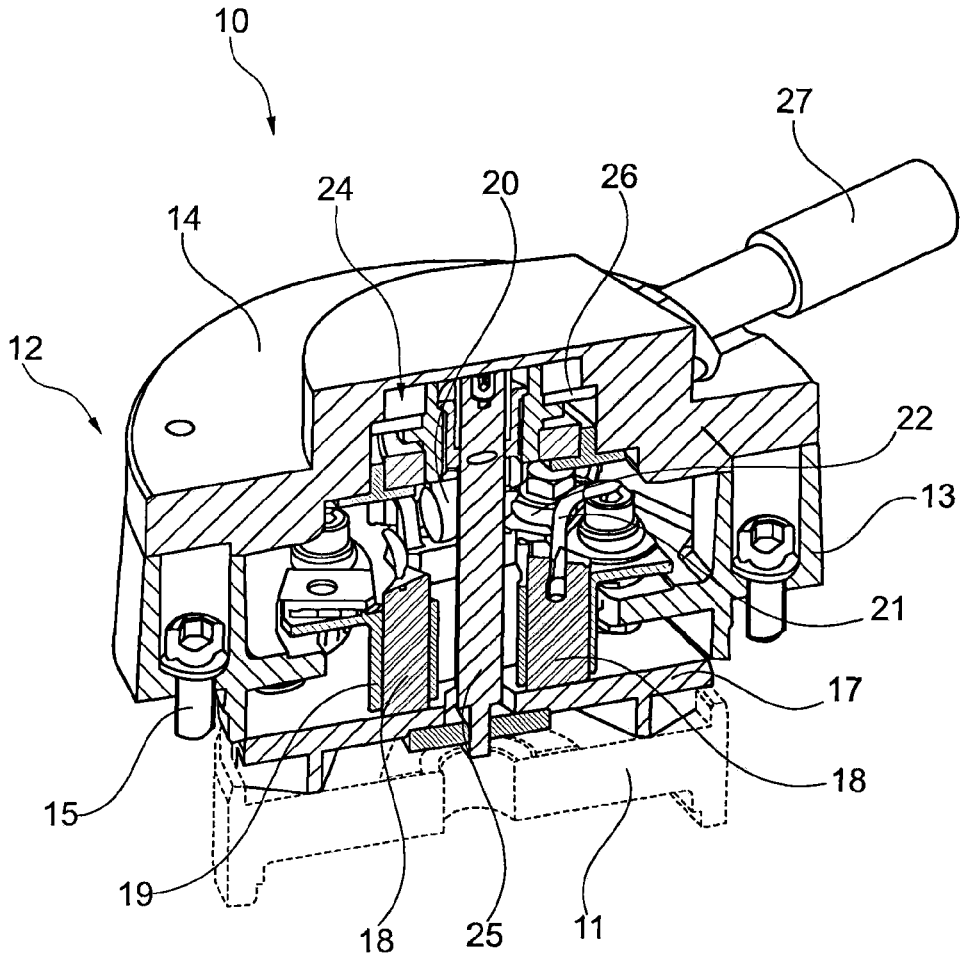
FIG. 2 is a perspective lengthwise view of a cross section through a grounding contact.

FIG. 1 and FIG. 2 together show a grounding contact 10 on an axle, not shown, of an electric locomotive. An axial end cap 11 of the axle is represented here by a dotdashed line. In addition, an axle bearing block to which grounding contact 10 is bolted is also not shown to simplify the drawing.

Grounding contact 10 comprises a housing unit 12 which consists solely of a housing structure 13 and a housing cover 14. Bolts 15 enable housing structure 13 to be mounted on the bearing block. In addition, a contact device 16 of grounding contact 10 consists here of a contact disc 17 and contact elements 18 essentially made from graphite. The contact elements 18 are accommodated in a contact element bracket 19, and each is pressed individually against contact disc 17 via a spring mechanism 20 to create an electric sliding contact. Contact elements 18 are also connected electrically to contact element bracket 19 via braided wires 21, wherein a connecting member 22 is connected to contact element bracket 19 via a cable 23 that connects grounding contact 10 electrically to a motor in known manner.

A sensor device 24 is arranged inside housing cover 14 and is connected to the axle, not shown here, via an axle extension element 25. Axle extension element 25 is supported so as to be rotatable in housing cover 14 and is connected to a rotary encoder 26 of sensor device 24. Signals received from rotary encoder 26 are processed further by a signal output device having the form of an electronics unit, not shown in further detail here, which is located inside housing cover 14, and are then forwarded to a vehicle controller of the electric locomotive, not visible here, via a signal cable 27. The electronics unit is designed such that the rotary encoder pulses derived from rotary encoder 26 are converted into as many as six different signals. Although a sensor device 24 in the form of an encoder is described, the sensor device can also be an ammeter and/or temperature sensor without departing from the scope of the invention.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

The invention claimed is:

1. A grounding contact for an axle, particularly an axle of a rail vehicle or the like, said grounding contact comprising:

a housing unit having housing structure and a housing cover;

a contact device having a contact disc and a contact element, said contact element being rotatably fixable relative to an axle and slidably contacting said contact disc; and a sensor device having at least one sensor acquiring an operating parameter of the axle, wherein the sensor device is arranged inside the housing unit and outputs at least two signals having differing structures.

2. The grounding contact as recited in claim 1, in which the sensor device is able to further process signal information from the at least one sensor before it is output to a signal.

3. The grounding contact as recited in claim 1, in which the housing unit consists solely of the housing structure and the housing cover.

4. The grounding contact as recited in claim 1, in which the sensor device is a rotary encoder.

5. The grounding contact as recited in claim 1, in which the sensor device is a temperature sensor.

6. The grounding contact as recited in claim 1, in which the sensor device is an ammeter.

7. The grounding contact as recited in claim 1, in which the sensor device is able to output at least six signals, each of which having a different structure.

8. The grounding contact as recited in claim 1, in which the sensor device is integrated in the housing cover.

9. The grounding contact as recited in claim 1, in which the housing cover is constructed as a single part.

10. The grounding contact as recited in claim 1, in which the axle is an axle extension element.

11. The grounding contact as recited in claim 10, in which the axle extension element protrudes into the housing cover.

12. The grounding contact as recited in claim 10, in which the axle extension element is supported inside the housing cover.

* * * * *